US006296023B1

(12) United States Patent
Gehrhardt et al.

(10) Patent No.: US 6,296,023 B1
(45) Date of Patent: Oct. 2, 2001

(54) WOVEN FABRIC FOR WORK CLOTHING PARTS

(76) Inventors: Manfred Gehrhardt, Julius-Bührer-Strasse 4, D-78224 Singen; Britta Smeulders, Industriestrasse 7-13, D-46359 Bocholt; Reinhilde Burg; Michael Görmer, both of Billbrookdeich 210, D-22113 Hamburg, all of (DE)

( * ) Notice: Subject to any disclaimer, the term of this patent is extended or adjusted under 35 U.S.C. 154(b) by 0 days.

(21) Appl. No.: 09/424,366

(22) PCT Filed: Mar. 30, 1999

(86) PCT No.: PCT/EP99/02169

§ 371 Date: Feb. 17, 2000

§ 102(e) Date: Feb. 17, 2000

(87) PCT Pub. No.: WO99/50491

PCT Pub. Date: Oct. 7, 1999

(30) Foreign Application Priority Data

Mar. 31, 1998 (DE) ..... 298 05 867 U

(51) Int. Cl.[7] ..... D03D 15/00

(52) U.S. Cl. ..... 139/420 A; 139/383 R; 139/426 R

(58) Field of Search ..... 139/383 R, 420 A, 139/426 R

(56) References Cited

U.S. PATENT DOCUMENTS

| | | | | |
|---|---|---|---|---|
| 3,744,534 | * | 7/1973 | Henry et al. | 139/426 R |
| 4,001,477 | * | 1/1977 | Economy et al. | 442/302 |
| 4,067,210 | * | 1/1978 | Arons et al. | 66/202 |
| 4,331,729 | * | 5/1982 | Weber | 428/252 |
| 4,573,500 | * | 3/1986 | Bouglas | 139/426 R |
| 4,865,906 | * | 9/1989 | Smith, Jr. | 442/197 |
| 5,150,476 | | 9/1992 | Statham et al. . | |
| 5,356,700 | * | 10/1994 | Tanaka et al. | 442/199 |
| 5,399,418 | * | 3/1995 | Hartmanns et al. | 428/218 |
| 5,527,597 | * | 6/1996 | Stanhope et al. | 442/184 |

FOREIGN PATENT DOCUMENTS

| | | |
|---|---|---|
| 35 44 493 | 1/1987 | (DE) . |
| 44 08 141 | 10/1994 | (DE) . |
| 0 228 026 | 7/1987 | (EP) . |
| 0 432 100 | 6/1991 | (EP) . |
| 2 179 068 | 2/1987 | (GB) . |

* cited by examiner

*Primary Examiner*—John J. Calvert
*Assistant Examiner*—Robert H. Muromoto, Jr.
(74) *Attorney, Agent, or Firm*—Venable; John P. Shannon; Chad C. Anderson

(57) ABSTRACT

A piece of woven fabric cut to production size for the manufacture of articles of work clothing for protection from heat, flames, and electric arc effect is characterized by a 3/1 frame casing having approximately 36 threads per centimeter of chain and approximately 23 threads per centimeter of weft. The overall mixtures of chain yarn and weft yarn are approximately 41 percent viscose, approximately 30 percent to 41 percent meta-aramide, approximately 17 percent to 29 percent paramide, and approximately 1 percent polyamide with a carbon core, and by doubled yarns with count No. 40/2.

4 Claims, No Drawings

WOVEN FABRIC FOR WORK CLOTHING PARTS

The invention relates to a woven fabric for manufacture of articles of work clothing for protection from heat, flames, electric arc effects, and the like.

The need has long existed for welders for the development of materials for protective clothing articles which meet the high requirements for low flammability, for example, and afford high wearing comfort. It is to be added that these articles of clothing are intended for industrial operations, that is, they are made available to personnel for a short period of time, after which they are cleaned and are used again. A large number of wearings is required; hence, a long service life is an important requirement, and over the service life, the pertinent testing regulations must be compiled with.

In the past, the materials provided for this purpose have never been able to meet all the requirements of the testing regulations and ensure wearing comfort at the same time. For the most part, thermally stable articles of clothing have provided very low wearing comfort for the person protected. It is to be noted in this connection that the thermal effect itself represents stress on the person at work.

The typical requirements which the woven fabric or an article of clothing made from this fabric must satisfy include:

1. Meeting the requirements for thermal stress in the form of contact or radiative heat or from open flame.
2. Safety from sparks and minute bits of incandescent metal flying at high speed and generated, for example, by welding, cutting, or flexing.
3. Protection from the action of light arcs through electrical discharges.
4. Resistance to mechanical stresses applied by objects with sharp edges, such as sheets of metal.
5. Ability to withstand the stresses resulting from industrial treatment in cleaning and restoration of the protective effect (washing, drying, decontamination).
6. Achievement of high physical comfort during wear.

For example, protective clothing consisting of trousers and a jacket is known (DE 91 01 311 UI). Its object is to protect its wearer from the action of flame and for this purpose, has a first outer layer of flame-retarding fabric for prevention of the flow of electricity through the body, a second windproof and watertight but water vapor-permeable barrier layer against passage of current, a third low-flammability electric barrier layer, and a fourth, innermost, lining layer. Protective clothing such as this may be used only in an electrical environment, if at all, and affords only slight comfort for its wearer.

A textile material for the inner lining based on multifilament amide thread for increasing the wearing comfort of protective clothing of firefighting personnel is known (DE 44 08 141 A1). However, the properties relevant to protective clothing cannot be maintained after repeated cleaning of the state-of-the-art inner lining.

The invention undertakes solution of the problem of meeting all the requirements indicated above by means of a woven fabric, in particular also if an article of clothing has been cleaned many times.

This solution is achieved by means of the materials, properties, and structures indicated in connection with which the following embodiments are discussed.

"Count" refers to a method of expressing the length per unit mass of a yarn. "Yarn" is a generic term for any linear textile structures. "ISO 2060" refers to the yarn fineness.

"ISO 3572" refers to the binding of the fabric. "DIS 721 1/2" refers to the number of threads in a chain and weft orientation. "ISO 3801" refers to the fabric weight in g/m$^2$. "NOMEX" is a trademark name of meta-aramide manufactured by DuPont Co. "KEVLAR" is a trademark name of paramide manufactured by DuPont Co. "Visc. Fr." represents the Viscose Flame Retardant Count.

EXAMPLE I

Article of clothing with a 3/1 frame consisting of approximately 36 fibers per centimeter chain and 23 fibers per centimeter weft with threads of two-ply yarn of fineness No. 40/2 in an overall yarn mixture of 41 percent viscose, 35 percent meta-aramide, 23 percent paramide, and 1 percent polyamide with a carbon core.

EXAMPLE II

A woven fabric with 3/1 frame casing with twisted thread of count No. 40/2 which is made up of 1. Thread of count No. 50/1 with 68 percent meta-aramide, 30 percent paramide, and 2 percent polyamide with a carbon core, and
2. Thread of count No. 30/1 with 64.3 percent viscose, 24 percent meta-aramide, 11 percent paramide, and 0.7 percent polyamide with a carbon core and which has the following mixture:

40 percent FR viscose, 41 percent meta-aramide, 18 percent paramide, and 1 percent polyamide with a carbon core.

EXAMPLE III

A woven fabric with a 3/1 frame casing with double yarn (count No. 40/2), consisting of a 1. Thread (count No. 50/1) of paramide and a
2. A thread (count No. 30/2) of 64.3 percent viscose, 24 percent meta-aramide, 11 percent paramide, and 0.7 percent polyamide with a carbon core, with the following total yarn mixture of 40.5 percent viscose, 44 percent paramide, 15 percent meta-aramide, and 0.5 percent polyamide with a carbon core.

EXAMPLE IV

A woven fabric of the following woven fabrics

Chain: 1.2 percent P140 (carbon fiber)/17.8 percent Kev (aramide)/40.4 percent Nx (aramide)/40.6 percent visc. FR Weft: 1.2 percent P140 (carbon fiber)/17.8 percent Kev (aramide)/40.4 percent Nx (aramide)/40.6 percent visc. FR, with ISO 2060 thread and yarn count of No. 19/Z and texture, ISO 3572, frame casing 3/1, with a DIS 7211/2 set of Chain: 356.6 thread/cm Weft: 232.5 thread/cm and an ISO 3801 basis weight of 338.139/m$^2$.

What is claimed is:

1. A piece of woven fabric cut to production size for manufacture of articles of work clothing for protection from heat, flames, and electric arc effects, characterized by a 3/1 frame casing comprising approximately 36 threads per centimeter of chain and approximately 23 threads per centimeter of weft, by overall mixtures of chain yarn and weft yarn of
approximately 41 percent vicose,
approximately 30 percent to 41 percent meta-aramide,
approximately 17 percent to 29 percent paramide, and
approximately 1 percent polyamide with a carbon core, and by double yarns with count No. 40/2.

2. A woven fabric as described in claim 1, characterized by a doubled yarn with a count No. 40/2 and comprising:

a. a first thread of count No. 50/1 having the following staple components:
approximately 68 percent meta-aramide;
approximately 30 percent paramide; and
approximately 2 percent polyamide with a carbon core; and b. a second thread of count No. 30/1 having the following staple components:
approximately 65 percent viscose;
approximately 24 percent meta-aramide;
approximately 11 percent paramide; and
approximately 0.7 percent polyamide with a carbon core; and wherein said first and second threads are twisted together to form a twisted thread having the following mixture:
approximately 40 percent FR viscose;
approximately 40 percent meta-aramide;
approximately 18 percent paramide; and
approximately 1.2 percent polyamide with a carbon core.

3. A woven fabric as described in claim 1, characterized by a double twist yarn with count No. 40/2 comprising:

a. a first thread of count No. 50/1 having the following staple component:
100 percent paramide; and b. a second thread of count No. 30/2 having the following staple components:
approximately 65 percent viscose;
approximately 24 percent meta-aramide;
approximately 11 percent paramide;
approximately 0.7 percent polyamide with a carbon core; and wherein said first and second threads are twisted together to form an overall twisted mixture with the following staple components:
approximately 41 percent viscose;
approximately 44 percent paramide;
approximately 15 percent meta-aramide; and
approximately 0.5 percent polyamide with a carbon core.

4. A piece of woven fabric for articles of work clothing for protection from heat, flames, and electric arc effects, characterized by the following features:

a textile material comprising:
a chain of 1.2 percent P140 carbon fiber, 17.8 percent KEVLAR aramide, 40.4 percent NOMEX aramide, and 40.6 percent visc. FR; and
a weft of 1.2 percent P140 carbon fiber, 17.8 percent KEVLAR aramide, 40.4 percent NOMEX aramide, and 40.6 percent visco FR;
said material having a yarn or twist count ISO 2060 and having
a chain of No. 19/twist, and
a weft of No. 19/twist; and
said material having a fabric texture of ISO 3572 and having
a frame casing 3/1;
said material having a Set, DIS 7211/2 and having a
a chain of 350±10 threads per centimeter; and
a weft of 250±10 threads per centimeter; and
said material having a basis weight ISO 3801 and 335±10 g/m$^2$.

* * * * *